US006244617B1

(12) United States Patent
Chonier et al.

(10) Patent No.: US 6,244,617 B1
(45) Date of Patent: Jun. 12, 2001

(54) SKI BINDING HEEL PIECE

(75) Inventors: Frédéric Chonier; André-Jean Kruajitch, both of Nevers (FR)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/118,534

(22) Filed: Jul. 17, 1998

(30) Foreign Application Priority Data

Jul. 22, 1997 (FR) ..... 97 09534

(51) Int. Cl.[7] ..... A63C 7/10; A63C 9/08

(52) U.S. Cl. ..... 280/605; 280/624; 280/618; 280/620

(58) Field of Search ..... 280/605, 604, 280/636, 618, 620, 624, 626

(56) References Cited

U.S. PATENT DOCUMENTS 4,294,459 * 10/1981 Svoboda et al. ..... 280/605
4,537,418 * 8/1985 Knabel et al. ..... 280/605
4,602,803 * 7/1986 Guitel ..... 280/605
4,681,338 * 7/1987 Spitaler ..... 280/626
4,863,186 * 9/1989 Rullier et al. ..... 280/626
5,002,303 * 3/1991 Freisinger et al. ..... 280/605
5,540,458 * 7/1996 Arduin et al. ..... 280/602
5,730,457 * 3/1998 Couderc et al. ..... 280/605

FOREIGN PATENT DOCUMENTS 370330B 3/1983 (AT) .
376374B 11/1984 (AT) .
0159203 1/1985 (EP) .

* cited by examiner

*Primary Examiner*—Michael Mar
*Assistant Examiner*—Hau Phan
(74) *Attorney, Agent, or Firm*—Bugnion S.A.; John Moetteli

(57) ABSTRACT

A heel piece of a safety binding for a ski boot, comprising a sole grip body (7) which is mounted on a stirrup piece (4, 5) articulated to a plate (3) which is in turn mounted so as to pivot on a base (2) mounted and immobilized on a rail (1) which is fixed to the ski. The heel piece is equipped with a ski brake (8) which is mounted on the base (2), in front of the pivoting plate (3) so that it moves with the base and remains at a fixed distance from the pivot axis.

5 Claims, 2 Drawing Sheets

6
7
11
15
9
13
10
14
4
2
1
22
20a
19a
19
21
3
20
26
23
26
27
36
40
37
a
x
30
35
8a
8
38
32
28
b
8b
33
38a

SKI BINDING HEEL PIECE

FIELD OF THE INVENTION

The present invention relates to a heel piece of a safety binding for a ski boot, comprising a sole grip body which is mounted on a stirrup piece articulated to a plate which is in turn mounted so as to pivot on a base mounted and immobilized on a rail which is fixed to the ski.

PRIOR ART

A heel piece of this type has been marketed by the applicant under the brand LOOK 37. Apart from the way in which the base is mounted on a rail, this heel piece is produced as described in patent CH 397 500.

This heel piece is intended to interact with a front binding, or toe piece, associated with a ski brake which can be raised by the pressure exerted by the boot on a pedal articulated to the arms of the brake. The position of the brake close to the front toe piece is unfavourable, because it tends to hinder insertion of the front end of the boot, in particular the sole, under the jaw of the front toe piece. It would therefore be preferable to arrange the brake close to the heel piece, as is the case in other types of bindings.

It would furthermore be appropriate for the position of the brake relative to the position of the pivoting plate not to vary as the base is moved on the rail, for adjusting the length of the binding.

SUMMARY OF THE INVENTION

To this end, the heel piece according to the invention is one which is equipped with a ski brake arranged in front of the pivoting plate, this brake being mounted on the base and articulated about an articulation axis that is transverse relative to the base and can be raised by the pressure exerted by the boot.

The distance between the pivot axis of the pivoting plate and the articulation axis of the brake is furthermore less than 70 mm, and preferably less than 20 mm, so that the brake is always actuated by the pressure of the heel region of the boot. This is desirable not only because of the optimum pressure exerted by the boot, but also because of the fact that the lower face of the sole of the boot, in front of the heel, often does not have enough area to actuate the pedal of the brake.

In the heel piece according to the prior art, the diameter of the pivot of the pivoting plate is such that the maximum distance of 70 mm cannot be adhered to. In order to achieve this maximum distance, it is possible to reduce the diameter of the pivot, but the forces on the latter and the play in the vertical planes increase rapidly as the diameter of the pivot decreases. Controlling these parameters properly leads to extra cost.

In order to solve this problem, in a preferred embodiment of the invention, the plate is pivotably mounted on the base through the mutual engagement and interaction of at least one rib in the form of an arc of a circle in a cutout in the form of an arc of a circle, these circle arcs being located between the pivot axis of the plate and the rear of the base.

According to a particular embodiment of the invention, the cutout in the form of an arc of a circle is formed in the pivoting plate, and the base has at least two concentric ribs interacting with each of the sides, in the form of an arc of a circle, respectively of the cutout.

BRIEF DESCRIPTION OF THE DRAWINGS

The appended drawing represents an embodiment of the heel piece according to the invention by way of example.

DESCRIPTION OF THE PREFERRED EMBODIMENTS

Figure 1:
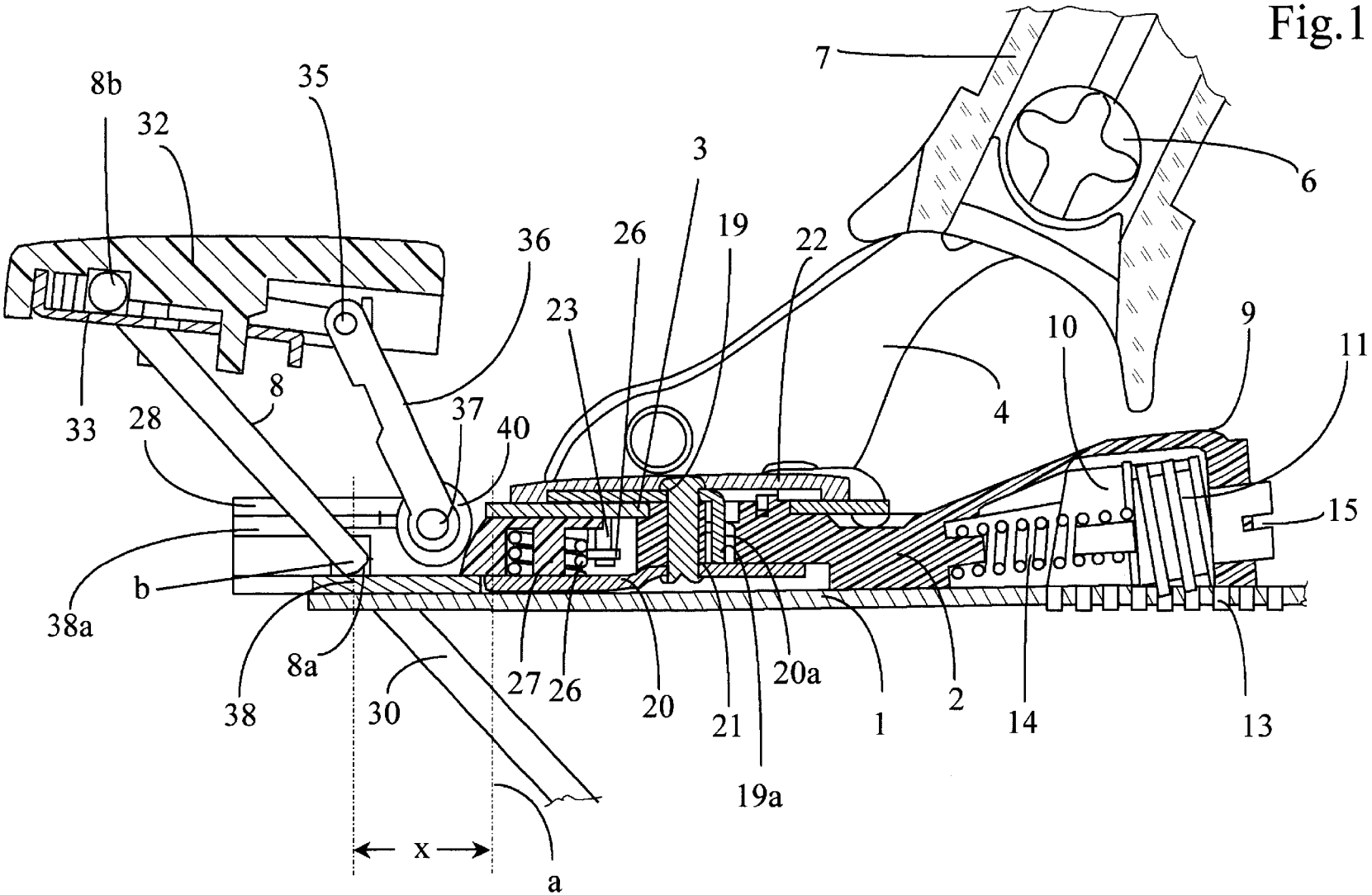
FIG. 1 represents a view in axial section thereof on a vertical plane.
Figure 2:
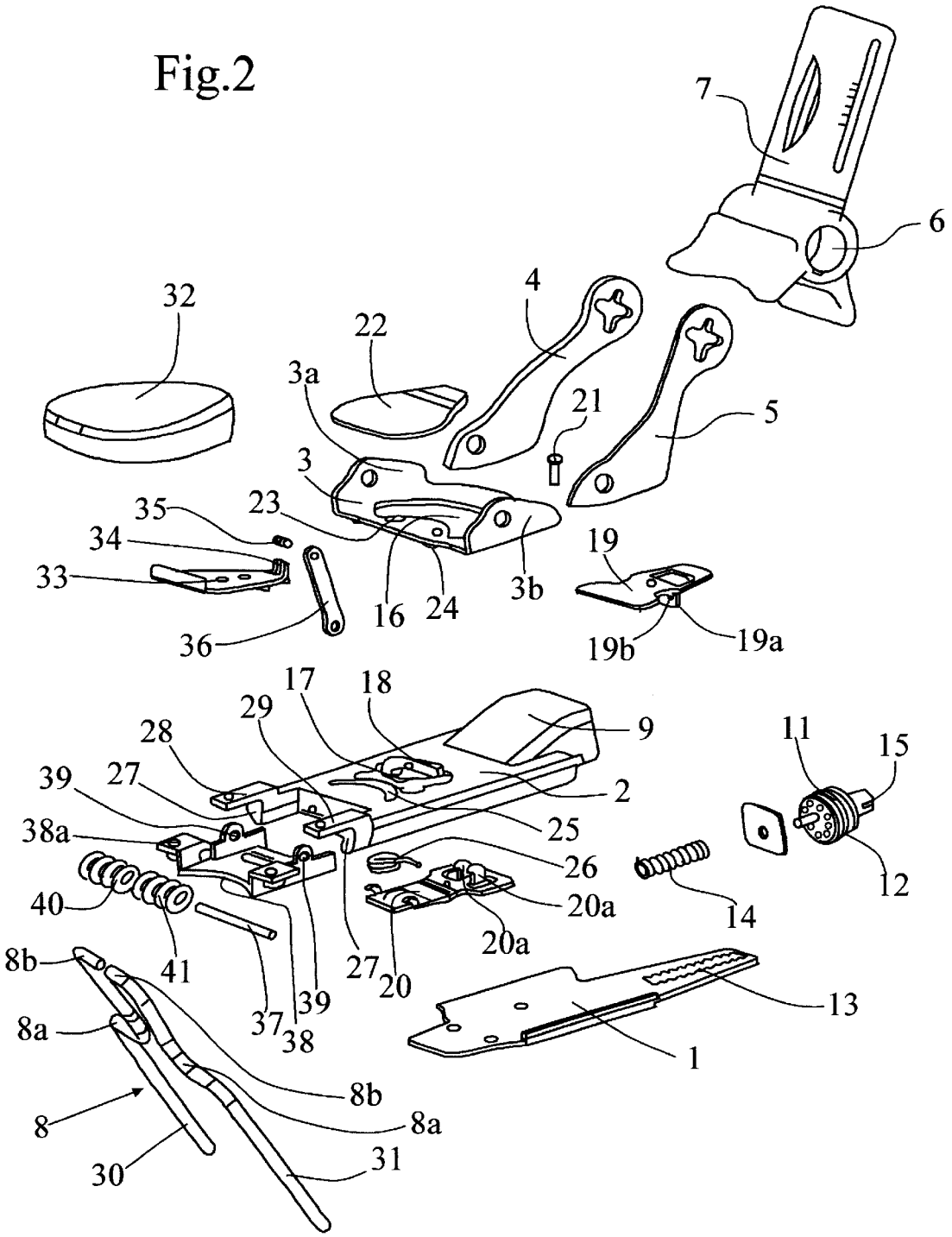
FIG. 2 is an exploded view of FIG. 1.

The heel piece which is represented essentially comprises a rail 1 which is intended to be fixed to a ski by means of screws, a base 2 which is made of molded synthetic material and is mounted on the rail 1 in such a way that it can slide longitudinally in order for its position to be adjusted, a plate 3 which is mounted so as to pivot on the base 2 and is provided with two parallel cheeks 3*a*, 3*b* to which a pair of parallel arms 4, 5 are articulated, a cam (not shown) extending between the upper ends of these arms and passing through the transverse bore 6 of a tubular binding body 7 which at the same time forms a heel grip, as represented and described in patent CH 397 500 and as is well known for this type of binding, an example of which is the LOOK 37 binding, and the brake 8 articulated to the front end of the base 2.

At the rear, the base 2 has an extra thickness 9 in which a housing 10 is formed. This housing 10 accommodates a cylindrical body 11 which has a helicoid rib 12 that interacts with a row of oblique grooves 13 formed in the rail 1. The cylindrical body 11 is pushed against the rear of the housing 10 by a spring 14, and can be rotated by a screw slot 15. These setting means are known per se and will not therefore be described in further detail.

In order for it to be pivoted, the plate 3 has a cutout 16 having two edges in the form of concentric circle arcs which determine the geometrical axis by which the plate 3 pivots and are located between this pivot axis and the rear 9 of the base 2. This cutout 16 interacts with ribs 17 and 18, in the form of arcs of circles, which are formed on the upper face of the base 2 on which the plate 3 rests. These ribs also determine the amplitude through which the plate 3 pivots. The pivoting plate 3 is held vertically on the base 2 by a small plate 19 which has a tab 19*a* cutout and bent through a right angle downward. This tab 19*a* has two holes 19*b*, in which two hooks 20*a* engage which are cutout and raised in a mating plate 20 placed under the base 2. The plates 19 and 20 are connected by a rivet 21 passing through the plate 3 and the base 2. The upper plate 19 is covered by a mask 22.

The plate 3 also has, in front of the cutout 16, two lugs 23 and 24 which are directed downward and pass through the base 2 via a slot 25 in the form of an arc of a circle centered on the pivot axis a of the plate 3. The ends of a torsion spring 26 which is mounted about a stud 27 linked to the base 2 bear on these lugs. The effect of the spring 26 is to bring the pivoting plate 3 into a central position after the binding has been released, through its action on the lugs 23, 24.

Toward the front, the base 2 has two front abutment faces 27, above which two arms 29 parallel to the longitudinal axis of the base and of the rail extend. The intermediate parts 8*a* of the brake arms 8 bear against these faces 27, these intermediate parts constituting the pivot axis of the brake which has two branches 30 and 31. These intermediate parts 8a are held at the top by the arms 28 and 29 of the base. The parts 8*a* define a geometrical pivot axis b (FIG. 1). The upper ends 8*b*, bent through a right angle, of the brake 8 are articulated in a brake pedal formed by an upper plate 32 and a lower plate 33 fixed to the plate 32 and trapping the ends 8*b* of the brake. The rear end of the plate 33 has a bent fork 34 which holds a pin 35 and allows passage for the end of a rod 36 which is articulated to the pedal 32 by the pin 35 and whose other end is articulated by means of a pin 37 to an auxiliary part 38 which is made of stamped metal and is fixed by rivets to the arms 28 and 29 of the base 2, under these arms and between these arms. The bar 37 is mounted in two yokes 39 formed on the plate 38, so that the bar 37 is essentially level with the upper face of the arms 28 and 29. Around the bar 37, on each side of the rod 36, two helical torsion springs 40 and 41 are mounted, the ends of which bear respectively on the part 38 and on the rod 36 so as to keep the rod 36 in the raised position represented in FIG. 1, that is to say to keep the brake arms 30 and 31 in a lowered braking position.

The articulations of the brake 8 and of the rod 36 are therefore linked to the base and therefore move with the base as the latter moves on the rail 1.

The creation of the pivot means by the inter-action of the cutout 16 and the ribs 17 and 18 has made it possible to bring the articulation axis b of the brake substantially close to the pivot axis a of the plate 3, at a distance x, while keeping a pivot (the ribs 17 and 18) of relatively large diameter and therefore ensuring good stability for the pivoting plate 3. This distance x can readily be less than 70 mm, which in all cases ensures that the pedal 32 is operated properly by the heel of the boot. The distance x may even be reduced to a value of less than 20 mm. As for the axis by which the pedal 32 is articulated to the base, which axis is formed by the pin 37, it may be very close to, or even secant with the pivot axis a of the plate 3.

On the basis of the mounting principle according to the invention, a number of alternative embodiments are possible. In particular, the cutout could be formed in the base 2 and the ribs could be formed on the plate 3. The cutout could be a simple hollowing.

The ribs could be replaced by a single rib of varying width.

In known fashion, the brake could be without a pedal. In this case, the axis b could be brought yet closer to the axis a.

What is claimed is:

1. In combination, a heel binding and brake assembly for attachment to a ski, comprising a longitudinally extending rail (1) which is fixed to a top surface of the ski, a base (2) mounted on the rail and longitudinally adjustable relative to the rail, a pivoting plate (3) mounted to the base so as to pivot about a pivoting axis (a) extending substantially perpendicular to the top surface of the ski, a stirrup piece (4, 5) articulately mounted to the pivoting plate for articulation about an axis extending substantially horizontal to the top surface of the ski, a heel piece articulately mounted to the stirrup piece, the heel piece having a sole grip body portion engageable with a sole portion of a user's boot, and a ski brake (8) removably mounted to the base, the ski brake having braking arms mounted to the base for articulation about an axis (b) extending transverse relative to a longitudinal axis of the ski with the articulation axis (b) being located forwardly of the pivoting axis of the plate (3), the braking arms being movable to a raised, nonbraking position upon downward pressure exerted by the user's boot upon a boot engageable portion of the ski brake.

2. The heel piece as claimed in claim 1, wherein the distance between the pivot axis (a) of the pivoting plate and the articulation axis (b) of the brake is less than 70 mm.

3. The heel piece as claimed in claim 1, wherein the distance between the pivot axis (a) of the pivoting plate and the articulation axis (b) of the brake is less than 20 mm.

4. The heel piece as claimed in claim 2, wherein the plate (3) is pivotably mounted on the base (2) through the mutual engagement and interaction of at least one rib (17, 18) in the form of an arc of a circle and a cutout (16) in the form of an arc of a circle, the at least one rib and the cutout being located between the pivot axis (a) and a rear end of the base (2).

5. The heel piece as claimed in claim 4, wherein the cutout (16) in the form of an arc of a circle is formed in the pivoting plate, and wherein the base has at least two concentric ribs (17, 18) interacting with said cutout (16), in the form of an arc of a circle.

* * * * *